US010117512B1

(12) United States Patent
Moore

(10) Patent No.: US 10,117,512 B1
(45) **Date of Patent: *Nov. 6, 2018**

(54) INSTRUMENT MUSIC LYRE

(71) Applicant: N. Lee Ann Moore, Hanahan, SC (US)

(72) Inventor: N. Lee Ann Moore, Hanahan, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/443,576

(22) Filed: Feb. 27, 2017

Related U.S. Application Data

(63) Continuation-in-part of application No. 14/955,217, filed on Dec. 1, 2015, now Pat. No. 9,622,572.

(51) Int. Cl.

| | |
|---|---|
| ***G10G 5/00*** | (2006.01) |
| ***A47B 23/00*** | (2006.01) |
| ***G10G 7/00*** | (2006.01) |
| ***A47B 23/06*** | (2006.01) |

(52) U.S. Cl.
CPC ..... *A47B 23/004* (2013.01); *A47B 23/06* (2013.01); *G10G 7/00* (2013.01)

(58) Field of Classification Search
CPC ..... A47B 23/004; Y10T 24/203
See application file for complete search history.

(56) References Cited

U.S. PATENT DOCUMENTS

| | | | | |
|---|---|---|---|---|
| 2,827,732 A * | 3/1958 | Shumaker | ..... | A47B 23/004 248/444 |
| 2,828,576 A * | 4/1958 | Fismen | ..... | A47B 23/004 248/444 |
| D255,459 S * | 6/1980 | Corder | ..... | D17/10 |
| 9,622,572 B1 * | 4/2017 | Moore | ..... | A47B 23/004 |

* cited by examiner

*Primary Examiner* — Amy J. Sterling
(74) *Attorney, Agent, or Firm* — Cramer Patent & Design, PLLC; Aaron R. Cramer

(57) ABSTRACT

A music lyre includes a saddle assembly having a shape approximately matching an outer profile shape of a top portion of an instrument, the saddle assembly including an opposing pair of lips, wherein a lip of the pair of lips is disposed on each side of the saddle assembly, a pair of straps connected to the saddle assembly, wherein a strap of the pair of straps is disposed on the each side of the saddle assembly, and wherein each strap of the pair of straps is configured to be wrapped underneath a bottom portion of the instrument and connected to a corresponding lip of the pair of lips disposed on an opposite side of the saddle assembly to secure the saddle assembly to the instrument; and a holder assembly connected to the saddle assembly, wherein the holder assembly is configured to retain at least one sheet of copy.

8 Claims, 6 Drawing Sheets

INSTRUMENT MUSIC LYRE

RELATED APPLICATIONS

The present invention is a continuation-in-part of U.S. application Ser. No. 14/955,217, filed on Dec. 1, 2015, which is a continuation of, was first described in, and claims the benefit of U.S. Provisional Application No. 62/085,713, filed Dec. 1, 2014, the entire disclosures of which are incorporated herein by reference.

FIELD OF THE INVENTION

The present invention relates generally to a lyre for retaining musical copy or other leaf-style items particularly suited for marching band brass instruments.

BACKGROUND OF THE INVENTION

The marching band is a time-honored and highly respected aspect of high-schools and colleges around the country. Most commonly seen at half time shows during football games, a marching band show provides the performers the opportunity to not only show off their musical talents, but also their synchronized chorographical skills. Many performers, especially those who play brass instruments, hold their music in a lyre or flip folder at the distal end of their instrument. As many of the band's movements are fast and even "vigorous", a common problem is that the sheet music holder tends to twist, turn, or even break and fall off. Accordingly, there exists a need for a means by which sheet music can be easily held on marching band instruments without the disadvantages as described above. The use of the music lyre enables marching band performers the ability to see their sheet music without worry at all times in a manner which is not only quick, easy, and effective, but non-disruptive as well.

SUMMARY OF THE INVENTION

The inventor has recognized the aforementioned inherent problems and lack in the art and observed that there is a need for an electronic watch charging device. The development of the present invention, which will be described in greater detail herein, fulfills this need.

In an embodiment, the disclosed music lyre includes a saddle assembly having a shape approximately matching an outer profile shape of a top portion of an instrument, the saddle assembly including an opposing pair of lips, wherein a lip of the pair of lips is disposed on each side of the saddle assembly, a pair of straps connected to the saddle assembly, wherein a strap of the pair of straps is disposed on the each side of the saddle assembly, and wherein each strap of the pair of straps is configured to be wrapped underneath a bottom portion of the instrument and connected to a corresponding lip of the pair of lips disposed on an opposite side of the saddle assembly to secure the saddle assembly to the instrument; and a holder assembly connected to the saddle assembly, wherein the holder assembly is configured to retain at least one (1) sheet of copy.

In another embodiment, the disclosed music lyre includes a saddle assembly including a saddle panel having a shape approximately matching an outer profile shape of a top portion of an instrument, the saddle panel including: a seat member; a pair of cinch members, wherein one (1) cinch member of the pair of cinch members extends outwardly from each side of the seat member; a saddle mounting plate connected to a first surface of the seat member, the saddle mounting plate includes a saddle fastener aperture located through a center of the saddle mounting plate and the seat member; an opposing pair of lips, wherein one (1) lip of the pair of lips is disposed on an end of the cinch member; and a padding layer connected to and coextensive with a second surface of the saddle plate, wherein the second surface is adapted to contact the instrument when the saddle panel is placed thereon; a pair of straps connected to the saddle assembly, wherein one (1) strap of the pair of straps is disposed on each side of the saddle panel, and wherein each strap of the pair of straps is configured to be wrapped underneath a bottom portion of the instrument and connected to a corresponding lip of the pair of lips disposed on an opposite side of the saddle panel to secure the saddle assembly to the instrument; and a holder assembly connected to the saddle assembly, the holder assembly including: a rear panel configured to retain at least one (1) sheet of copy is connected to the rear panel; a lower panel extending approximately perpendicularly from a lower end of the rear panel; and a holder mounting plate connected to a first surface of the lower panel, the holder mounting plate including a holder fastener aperture located through a center of the holder mounting plate and the lower panel, wherein the holder mounting plate engages the saddle mounting plate when the holder assembly is connected to the saddle assembly; and a fastener extending through the first aperture and second aperture when the holder mounting plate and the saddle mounting plate are engaged and the first aperture and second aperture are aligned to fasten the holder assembly to the saddle assembly.

In yet another embodiment, the disclosed music lyre includes a saddle assembly including a saddle panel having a shape approximately matching an outer profile shape of a top portion of an instrument, the saddle panel including a seat member; a first cinch member extending outwardly from a first side of the seat member; a second cinch member extending outwardly from a second side of the seat member; a saddle mounting plate connected to a top surface of the seat member, the saddle mounting plate including a saddle fastener aperture located through a center of the saddle mounting plate and the seat member; and a plurality of detents arranged in a second circular configuration adjacent an edge thereof; a first lip disposed on an end of the first cinch member, the first lip including a first ridge extending outwardly from the end of the first cinch member and forming a first groove between the first ridge and the first cinch member; a second lip disposed on an end of the second cinch member, the second lip including a second ridge extending outwardly from the end of the second cinch member and forming a second groove between the second ridge and the second cinch member; and a padding layer connected to and coextensive with a bottom surface of the saddle panel, wherein the second surface is adapted to contact the instrument when the saddle panel is placed on the instrument; a first elastic strap forming a first continuous loop connected to a first side of the saddle panel and configured to be wrapped underneath a bottom portion of the instrument, wherein the first strap is connected to the second lip to partially secure the saddle assembly to the instrument by the first continuous loop being received within the second groove and retained by the second ridge; a second elastic strap forming a second continuous loop connected to a second side of the saddle panel and configured to be wrapped underneath the bottom portion of the instrument, wherein the second strap is connected to the first lip to partially secure the saddle assembly to the instrument by the second continuous loop being received within the first groove and retained by the first ridge; and a holder assembly connected to the saddle assembly, the holder assembly including: a rear panel configured to retain at least one (1) sheet of copy is connected to the rear panel; and a lower panel extending approximately perpendicularly from a lower end of the rear panel; a holder mounting plate connected to a bottom surface of the lower panel, the holder mounting plate including: a holder fastener aperture located through a center of the holder mounting plate and the lower panel; and a plurality of protrusions arranged in a first circular configuration adjacent an edge thereof; and wherein the holder mounting plate engages the saddle mounting plate when the holder assembly is connected to the saddle assembly, the holder assembly is rotatably connected to the saddle assembly, alignment of the plurality of protrusions and the plurality of detents when the holder mounting plate and the saddle mounting plate are engaged and the first aperture and second aperture are aligned maintains an angular orientation of the holder assembly relative to the saddle assembly, and the holder assembly is removably connected to the saddle assembly by a fastener extending through the first aperture and second aperture when the holder mounting plate and the saddle mounting plate are engaged and the first aperture and second aperture are aligned to fasten the holder assembly to the saddle assembly.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
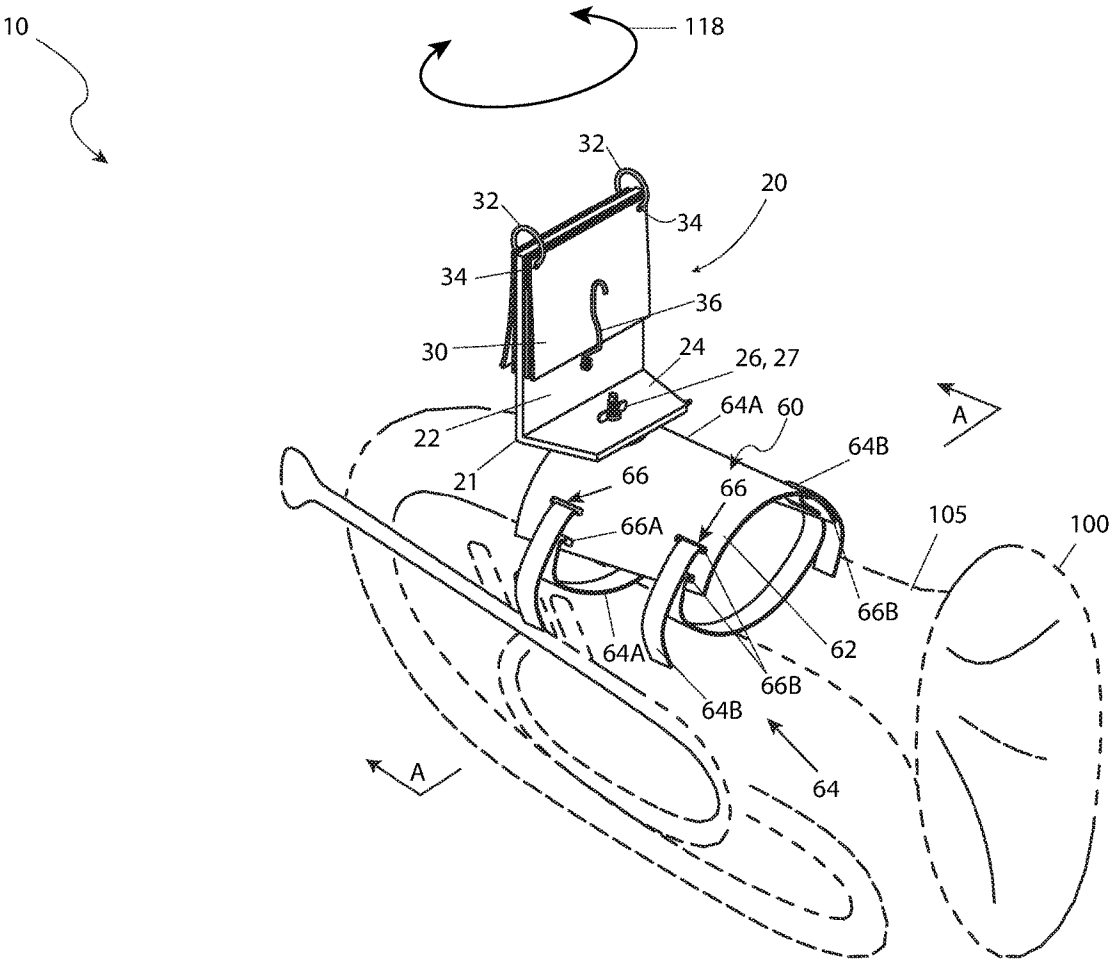
FIG. 1 is an environmental perspective view of an embodiment of the disclosed brass instrument music lyre.

10 brass instrument music lyre ("apparatus")
20 holder assembly
21 holder panel
22 rear panel
24 lower panel
25 holder fastener aperture
26 stud fastener
27 wing nut
28 saddle fastener aperture
30 copy
32 ring
34 ring aperture
36 stay
38 holder mounting plate
40 detent
60 saddle assembly
62 saddle panel
64 strap
64A first strap
64B second strap
65 loop
65A first loop
65B second loop
66 strap aperture
66A first strap aperture
66B second strap aperture
67 hook-and-loop fastener
68 saddle mounting plate
70 protrusion
76 padding
80 fastener
82 seat member
84 cinch member
86 lip
86A first lip
86B second lip
88 seat member-side
90 cinch member-side
92 groove
94 ridge
96 flange
98 seat member-side
100 instrument
105 bell/body
110 directional arrow

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

Referring to FIGS. 1-6, disclosing a brass instrument music lyre, referred to herein as the "apparatus" 10, where like reference numerals represent similar or like parts. As used herein, the term "lyre" refers to a small music stand or small sheet music holder. The apparatus 10 is configured to be removably attached to an instrument 100, such as one (1) of a variety of brass musical instruments. The apparatus 10 is configured to hold and support sheet music (e.g., one or more sheets of sheet music or printed music notation), generally referred to herein as "copy" 30, in a position for reading. As an example, the copy 30 is a paper score that is played by the user of the instrument 100. The apparatus 10 is envisioned to be especially useful for use by individuals who participate in marching bands or other brass bands.

Figure 2:
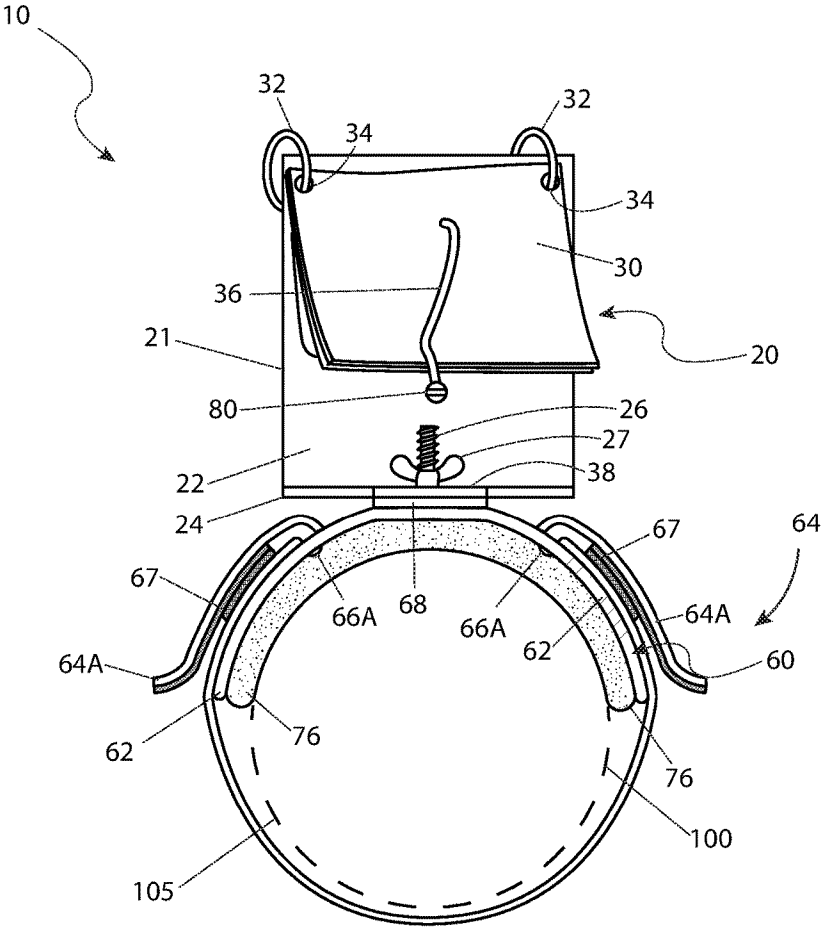
FIG. 2 is an end view, in section taken along section line A-A, of the brass instrument music lyre of FIG. 1.

FIG. 1 is a schematic illustration of an environmental perspective view of an embodiment of the disclosed apparatus 10. FIG. 2 is a schematic illustration of an end view, in section taken along section line A-A of FIG. 1, of the disclosed apparatus 10. The apparatus 10 includes a music holder assembly 20 and a saddle assembly 60. The saddle assembly 60 is configured to be removably connected to a bell/body 105 of the instrument 100. The holder assembly 20 is connected to the saddle assembly 60. The holder assembly 20 is configured to retain the copy 30 in a position for reading. The saddle assembly 60 is connects the holder assembly 20 to the bell/body 105 of the instrument 100.

The holder assembly 20 includes a holder panel 21. The holder panel 21 is configured to position and secure a plurality of individual sheets of the copy 30. The holder panel 21 is an L-shaped structure (having a shape in the form of the letter "L"). The holder panel 21 is rotatable relative to a saddle panel 62 of the saddle assembly 60 via respective upper mounting plate 38 and lower mounting plate 68 (FIG. 3) and is connected to the saddle panel 62 by a threaded stud 26 and a wing nut 27.

The holder assembly 20 may be made using any suitable materials. As an example, the holder panel 21 may be formed from a rugged, weather-resistant plastic or metal material. The holder panel 21 includes an approximately vertical rear panel 22 and an approximately horizontal lower panel 24. The lower panel 24 may depend outwardly from the rear panel 22 such that the rear panel 22 and the lower panel 24 are disposed approximately perpendicular to each other (e.g., having a combined shape in the form of the letter "L"). The rear panel 22 and/or the lower panel 24 may be generally planar (e.g., flat). As an example, the rear panel 22 and/or the lower panel 24 may include at least one (1) planar surface.

In an example embodiment, the lower panel 24 may taper from an edge attached to the rear panel 22 to an opposing edge. As an example, the lower panel 24 may have a first width proximate to (e.g., at or near) a joining edge interfacing with the rear panel 22 and a second width, smaller than the first width, at the free edge opposite the joining edge.

The rear panel 22 includes attachment features configured to position the plurality of sheets of copy 30, thereby allowing individual sheets of copy 30 to be flipped over to view a particular sheet of copy 30.

In an example embodiment, the holder assembly 20 is removably connected to the saddle assembly 60. In an example embodiment, the holder assembly 20 is rotatably connected (e.g., rotatable relative) to the saddle assembly 60, for example, in the direction of arrow 110 (FIG. 1). Thus, the saddle assembly 60 provides rotating connection of the holder assembly 20, thereby, allowing the holder assembly 20, and the copy 30, to be viewed in a "straight on" manner, or at any other angle relative to the user's field of view. Additionally, or alternatively, the holder assembly 20 may be rotated one-hundred eighty degrees (180°) to allow access to a reverse side of the copy 30 (e.g., a musical score printed in a backside of the paper).

The saddle assembly 60 includes the saddle panel 62. Generally, the saddle panel 62 has a profile shape (e.g., cross-sectional shape) that approximately matches a portion of a profile shape (e.g., cross-sectional shape) of the instrument 100, such as an upper, or top, portion of the profile shape of the body 105 proximate the bell (the round, flared opening opposite the mouthpiece) of a brass or other wind instrument. As an example, the saddle panel 62 has a nonlinear (e.g., arcuate) shape in cross section.

In an example, embodiment, the saddle panel 62 may be made of a flexible material configured to conform (e.g., bend) to the profile shape of the body 105 of the instrument 100. In this example, the same apparatus 10 may be used on (connected to) various, different types of instruments 100.

Alternately, in another example, the saddle panel 62 may be made of a semi-rigid material. In this example, the saddle panel 62 may include a preformed profile shape approximating the profile shape of the body 105 of the instrument 100. The semi-rigid material may also be capable of flexing or bending to small degree to conform to profile shape of the body 105 of the instrument 100.

In an example embodiment, the saddle assembly 60 includes at least one (1) strap 64 (identified herein as a first strap 64A and a second strap 64B) to securely attach the apparatus 10 to the instrument 100. The length of each strap 64A, 64B is easily adjustable to fit different sizes and types of instruments 100. The straps 64A, 64B can also be installed and/or removed quickly and without the need for a tool. In an example embodiment, the straps 64A, 64B may be fabricated from a material that provides a sufficient width to provide a friction interface between (e.g., in contact with) a surface of the instrument 100 to stabilize the apparatus 10 upon the instrument 100.

The holder assembly 20 includes at least one (1) ring 32 (e.g., a pair of rings 32 are shown) connected to the rear panel 22 of the holder panel 21. In an example embodiment, the holder panel 21 includes at least one (1) ring aperture 34 (e.g., a pair of ring apertures 34 are shown) formed through the rear panel 22. The rings 32 may be connected to the rear panel 22 through the ring apertures 34. In an example embodiment, the ring apertures 34 and, thus, the rings 32 are disposed proximate to an upper, or top, edge of the rear panel 22. In an example embodiment, the pair of ring apertures 34 and, thus, the pair of rings 32 are disposed proximate to opposed upper corners of the rear panel 22.

The rings 32 in turn pass through holes punched, or otherwise forms, in the copy 30, thereby, allowing the copy 30 to be quickly flipped over by the user. Furthermore, it is envisioned that the copy 30 may be arranged in a back-to-back manner having pairs that are either laminated using clear plastic, or contained in clear plastic sleeves, to maximize a number of sheets or pages of copy 30 present upon the holder assembly 20.

Referring now particularly to FIG. 2, in an example embodiment, the saddle assembly 60 include a layer of padding 76 (also referred to as a padding layer) connected to or otherwise disposed on a bottom, or underside, surface of the saddle panel 62. As an example, the padding 76 may be affixed to the bottom surface of the saddle panel 62 using adhesives or other type of bonding material. In an example embodiment, it is envisioned that various models of the apparatus 10 include padding 76 having a custom shape to match the contours of a particular instrument 100 onto which the apparatus 10 is installed.

Referring to FIGS. 1 and 2, in an example embodiment, the holder assembly 20 also includes at least one (1) stay 36 connected to the rear panel 22 of the holder panel 21. As an example, the stay 36 may be connected to a backside surface (e.g., opposite a viewing surface) of the rear panel 22. As another example, the stay 36 may be connected to a frontside surface (e.g., the viewing surface) of the rear panel 22. As another example, a pair of stays 36 may be connected to both the frontside and the backside surfaces of the rear panel 22. The stay 36 is configured to clamp and stabilize the position of the copy 30, for example, during windy conditions, in a stacked arrangement. In an example embodiment, the stay 36 includes a formed length of resilient wire connected to the rear panel 22, for example, using a fastener 80, such as a screw, rivet, or the like.

The straps 64 (e.g., first and second straps 64A, 64B) of the saddle assembly 20 are configured to provide for length-adjustment and a cinching attachment around the body of 105 of the instrument 100. As an example, and as illustrated in FIG. 1, the straps 64 are oriented approximately parallel to each other. The straps 64 wrap around the body 105, in a parallel manner, and an end of each strap 64*a*, 64*b* is looped through a respective sets of strap apertures 66 (identified herein as first strap apertures 66A and second strap apertures 66B). The strap apertures 66 are formed through the saddle panel 62 proximate to opposing edges of the saddle panel 62. As an example, the end of each strap 64 is looped through respective strap apertures 66 to reverse its direction, and is then secured to itself, for example, via an integral sewn-in hook-and-loop fastener 67 (FIG. 2), such as Velcro®, being positioned upon mating surfaces.

While the example embodiments illustrated in FIGS. 1 and 2 show each set of strap apertures 66 as including a pair of proximate and parallel strap apertures formed in the saddle panel 62 proximate to opposite longitudinal edges and proximate to opposite lateral edges (e.g., at or near the corners of the saddle panel 62), in other example embodiments, each set of strap apertures 66 may include one (1) strap aperture formed in the saddle panel 62 proximate to opposite longitudinal edges and proximate to opposite lateral edges. Additionally, the location of the strap apertures 66 and, thus, the straps 64 may vary depending upon the type of instrument 100 and/or the size of the apparatus 10. Further, the apparatus 10 may include fewer (e.g., one (1)) or more (e.g., three (3), four (4), etc.) sets of strap apertures 66 and, thus, straps 64.

Figure 3:
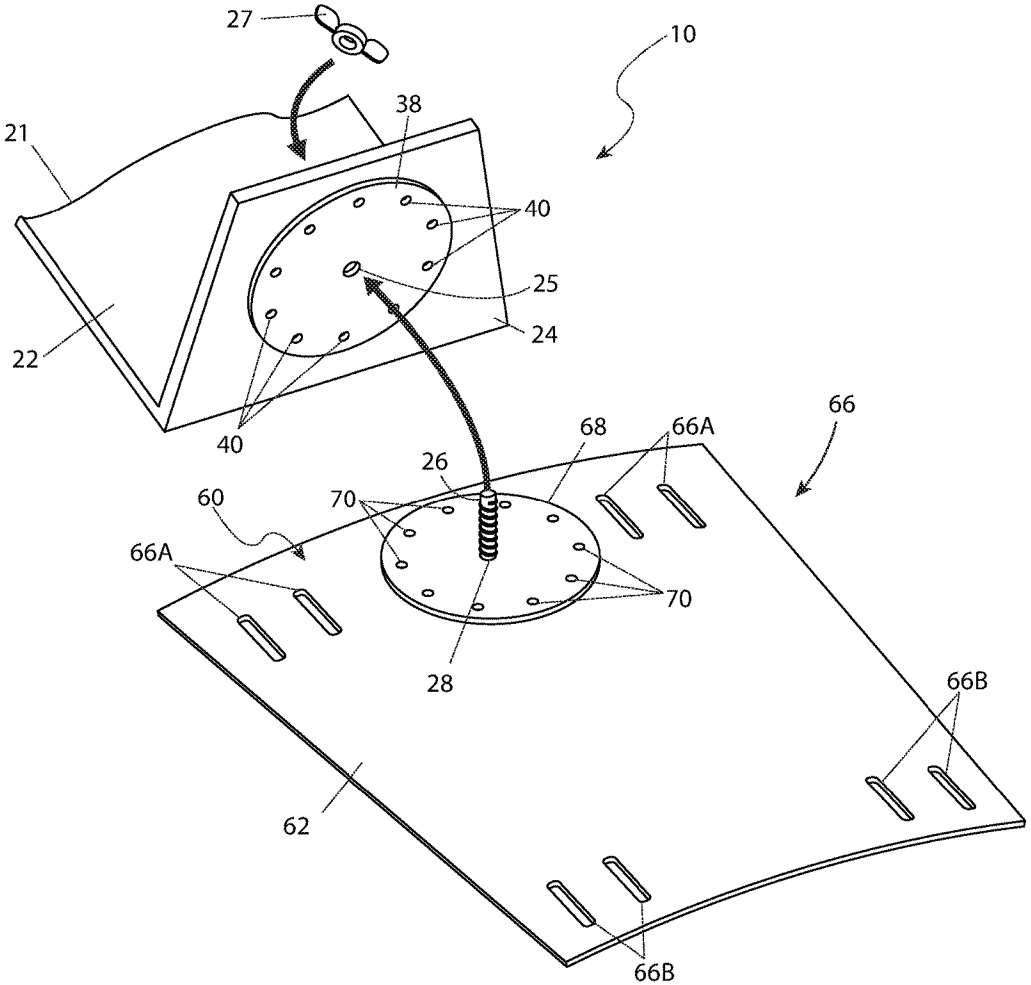
FIG. 3 is an exploded perspective view of an embodiment of a holder assembly and a saddle assembly of the disclosed brass instrument music lyre of FIG. 1.

FIG. 3 is a schematic illustration of an exploded view of an embodiment of the holder assembly 20 and the saddle assembly 60 of the disclosed apparatus 10. The apparatus 10 provides angularly selective attachment of the holder assembly 20 to the saddle assembly 60 via respective holder (e.g., upper) mounting plate 38 and saddle (e.g., lower) mounting plate 68. In an example embodiment, the holder mounting plate 38 is affixed (e.g., permanently connected or integral) to a bottom, or underside, surface of the lower panel 24 of the holder panel 21. The saddle mounting plate 68 is affixed (e.g., permanently connected or integral) to a top surface of the saddle panel 62. The holder assembly 20 includes a central holder fastener aperture 25 that extends through the center of the holder mounting plate 38 and through the lower panel 24. The saddle assembly 60 includes a threaded stud fastener 26 extending upwardly from a center of a top surface of the saddle mounting plate 68. As an example, the saddle assembly 60 includes a central saddle fastener aperture 28 that extends through the center of the saddle mounting plate 68 and through the saddle panel 62. The stud fastener 26 extends through the aligned fastener apertures 25, 28 when the mounting plates 38, 68 are engaged.

While the example embodiments illustrated in FIGS. 1 and 3 show the saddle mounting plate 68 and the stud 26 located proximate to an end of the saddle panel 62 closest to the user, in other embodiments, the location of the saddle mounting plate 68 and the stud 26 on the saddle panel 62 may vary and, thus, the location of the holder assembly 20 on the saddle panel 62 may vary. As an example, the saddle mounting plate 68 and the stud 26 may be located at or near a middle of the saddle panel 62, for example, as illustrated in the embodiments shown in FIGS. 4 and 6. As another example, the saddle mounting plate 68 and the stud 26 may be located proximate to another end of the saddle panel 62 farthest from the user. The saddle mounting plate 68 and the stud 26 may be located at any other position on the top surface of the saddle panel 62.

The holder mounting plate 38 also includes a plurality of equally-spaced, semi-spherical detents 40 arranged in a circular pattern along a bottom, or underside, surface of the holder mounting plate 38. Correspondingly, the saddle mounting plate 68 includes a plurality of equally-spaced, semi-spherical protrusions 70 arranged in a circular pattern along a top surface of the saddle mounting plate 68. Alternatively, the holder mounting plate 38 may include a plurality of equally-spaced, semi-spherical protrusions 70 arranged in the circular pattern along the bottom, or underside, surface of the holder mounting plate 38. Correspondingly, the saddle mounting plate 68 may include the plurality of equally-spaced, semi-spherical detents 40 arranged in the circular pattern along a top surface of the saddle mounting plate 68.

The holder assembly 20 and the saddle assembly 60 are attached by inserting the stud 26 up through the fastener aperture 25, mating the holder mounting plate 38 and the saddle mounting plate 68, and installing a wing nut 27 upon the stud 26. The position and size of the respective female and male semi-sphere shapes of the detents 40 and the protuberances 70 are configured to mate and engage with one (1) another as the mounting plates contact each other.

To position and secure the holder assembly 20 at a desired angle, a user loosens the wing nut 27 along the stud 26, lifts and rotates the holder assembly 20 to a desired orientation, and lowers the holder assembly 20 to engage the detents 40 and protuberances 70. The wing nut 27 is then tightened to retain the holder assembly 20 in the desired angular position.

Referring to FIGS. 1-3, in an example embodiment, the disclosed apparatus 10 includes the saddle assembly 60. The saddle assembly 60 includes the saddle panel 62 having a general shape corresponding to an outer profile of the instrument 100. The saddle assembly 60 also includes a saddle mounting plate 68 located on the top (e.g., a first) surface of the saddle panel 68. The saddle assembly 60 also include a padding layer 76 coextensive with the bottom (e.g., a second) surface of the saddle panel 68. The second surface being adapted to contact an exterior surface of the instrument 100 when the saddle panel 68 is placed on the instrument 100. The saddle assembly 60 also includes at least one (1) removable attachment straps 64 for attaching the saddle panel 68 to the instrument. The saddle assembly 60 also includes the pair of attachment strap apertures 66 on either side of a longitudinal centerline of the saddle panel 68 for receipt of each removable attachment strap 64. The apparatus 10 also includes the generally "L"-shaped holder assembly 20 rotatably attached to the saddle mounting plate 68 with a holder mounting plate 38. The holder assembly 20 includes the holder panel 21 having the rear panel 22 and the lower panel 24. The lower panel 24 has a first edge coextensive with and extending perpendicularly away from a first edge of the rear panel 22. The lower panel 24 tapers in width from the lower panel first edge to an opposing lower panel second edge. The holder mounting plate 38 is located on the bottom surface of the lower panel 24. The holder assembly 20 is capable of holding and retaining a plurality of individual sheets of copy 30. The plurality of individual sheets of copy is capable of being affixed to and retained by the rear panel 22, thereby enabling individual sheets to be viewed independently. The holder assembly 20 is capable of rotational positioning relative to the saddle assembly 60. Each removable attachment strap 64 is length adjustable. The strap 64 includes a material capable of providing a friction stability to the instrument 100. The rear panel 22 and the lower panel 24 are planar. The apparatus 10 also includes the pair of apertures 34, each located equidistant from a vertical center axis longitudinally bisecting the rear panel 22 adjacent a second edge opposite the rear panel first edge. The apparatus 10 also includes the pair of rings 32, each passing through an individual aperture 34. Each ring 32 is capable of securing to the plurality of individual sheets of copy 30. The apparatus 10 also includes the stay 36 having a first end affixed to the backside (e.g., a first) surface of the rear panel 22, superjacent from (e.g., above) the lower panel 24. A second end of the stay 36 is biased towards the rear panel first surface. The stay 36 is configured to retain the plurality of individual sheets of copy 30 in a stacked arrangement. The holder mounting plate 38 includes the first aperture 25 located in a center thereof and the plurality of detents arranged in a first circular configuration adjacent an edge thereof. The saddle mounting plate 68 includes the second aperture 28 located in a center thereof and the plurality of protrusions 70 arranged in a second circular configuration adjacent an edge thereof. The plurality of protrusions 70 is aligned with the plurality of detents 40 when the first and second apertures 25, 28 are aligned. The fastener 26 fastens the holder assembly 20 to the saddle assembly 60.

An example embodiment of the disclosed method of utilizing the apparatus 10 may be achieved by performing the following steps: procuring a model of the apparatus 10 that provides a saddle assembly 60 having a suitable fit onto an intended instrument 100; positioning the saddle panel 62 upon the body 105 of the instrument 100; wrapping a first strap 64A around the body 105; looping ends of the first strap 64A through respective pairs of strap apertures 66A, 66B in the saddle panel 62; extending the ends of the strap 64A back over themselves; cinching and fastening the ends of the strap 64A to themselves tightly around the instrument 100 by connecting the sewn-in hook-and-loop fasteners 67; repeating the above steps for the second strap 64B; installing the holder assembly 20 onto the saddle assembly 60, if not previously installed, by inserting the stud fastener 26 of the lower saddle mounting plate 68 up through the fastener aperture 25 of the upper holder mounting plate 38; installing the wing nut 27 upon the stud fastener 26 loosely; lifting and rotating the holder assembly 20 to a desired angular orientation and corresponding viewing angle; lowering the holder assembly 20 to engage the detents 40 and protuberances 70; securing the position of the holder assembly 20 by tightening the wing nut 27; preparing a plurality of sheets of copy 30 in a back-to-back manner; containing the copy 30 by either laminating or inserting the pairs of copy 30 in clear plastic sleeves; punching holes through the copy 30; mounting a desired number of sheets of copy 30 onto the rings 32 of the rear panel 22; and, securing the copy 30 to the rear panel 22 using the wire stay 36, as needed.

Figure 4:
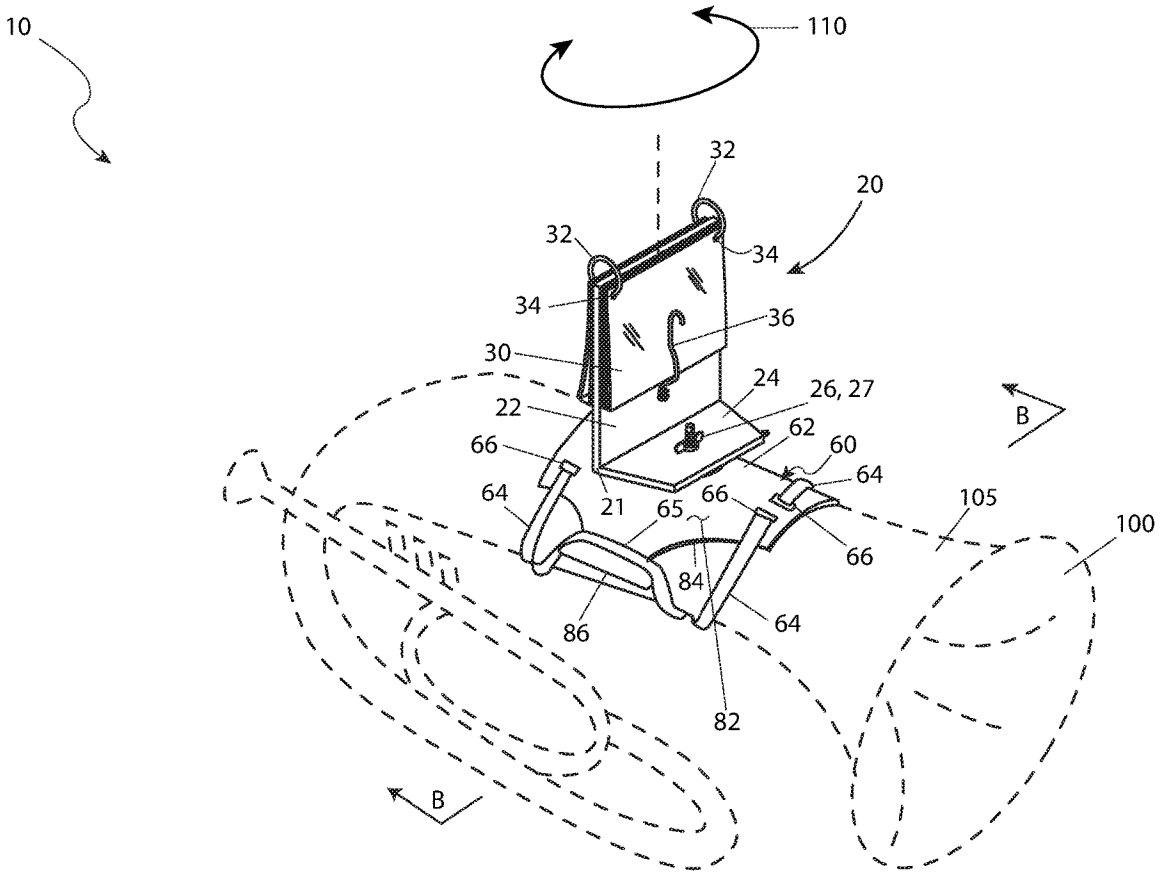
FIG. 4 is an environmental perspective view of another embodiment of the disclosed brass instrument music lyre.
Figure 5:
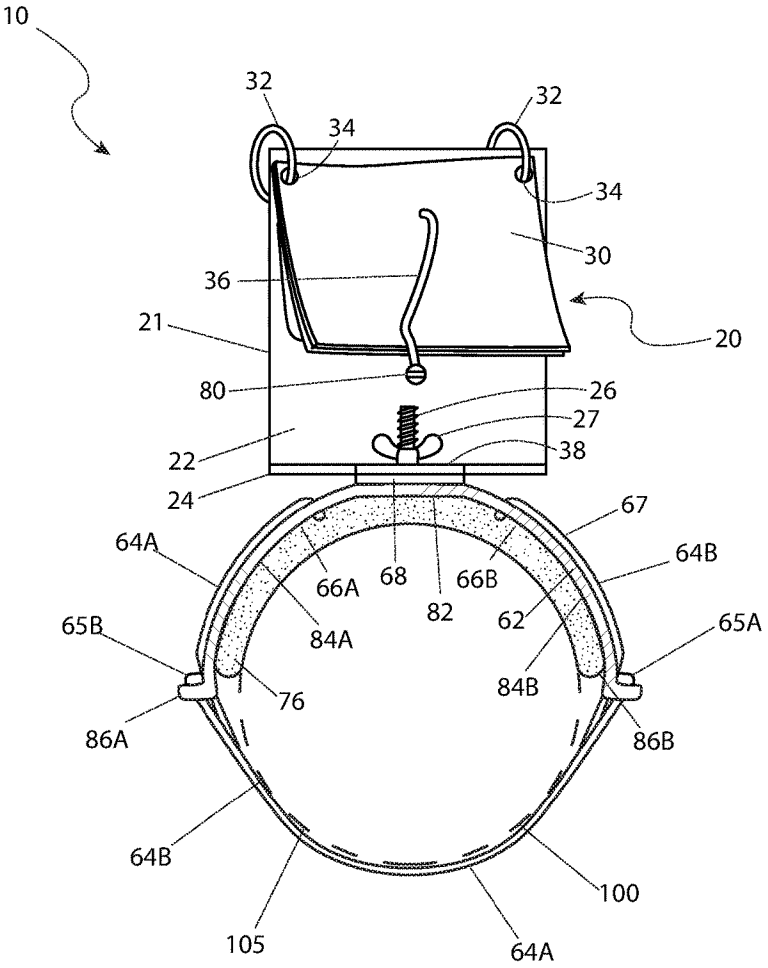
FIG. 5 is an end view, in section taken along section line B-B, of the brass instrument music lyre of FIG. 4; and, FIG. 6 is an exploded perspective view of another embodiment of the holder assembly and the saddle assembly of the brass instrument music lyre of FIG. 4.

FIG. 4 is a schematic illustration of an environmental perspective view of another embodiment of the disclosed apparatus 10. FIG. 5 is a schematic illustration of an end view, in section taken along section line B-B of FIG. 4, of the disclosed apparatus 10. In this embodiment, the saddle panel 62 includes a central seat member 82 and a pair of cinch members 84 (identified individually herein as a first cinch member 84A and a second cinch member 84B in FIG. 5) depending outwardly from opposing longitudinal sides of the seat member 82.

The seat member 82 is configured to contact and rest upon a portion of the top, or upper, surface of the body 105 of the instrument 100. In an example embodiment, at least a portion of the seat member 82 may be planar. In another example embodiment, at least a portion of the seat member 82 may be nonlinear, for example, having a curvature configured to conform to the profile shape of the portion of the body 105 of the instrument. In yet another example, at least a portion of a top surface of the seat member 82 may be planar for location and connection of the saddle mounting plate 68 (FIG. 2) and at least a portion of a bottom, or underside, surface of the seat member 82 may have a curvature approximately matching the profile shape of the body 105 of the instrument 100.

Each cinch member 84 extends from opposing sides of the seat member 82 and wraps at least partially around a portion of opposing sides of the body 105 of the instrument 100. As an example, the cinch members 84 may extend approximately halfway around the body 105 of the instrument 100.

Like the embodiment described above and illustrated in FIGS. 1-3, in an example, embodiment, the saddle panel 62 (e.g., the seat member 82 and the cinch members 84) may be made of a flexible material configured to conform (e.g., bend) to the profile shape of the body 105 of the instrument 100. In this example, the same apparatus 10 may be used on (connected to) various, different types of instruments 100.

Alternately, in another example, the saddle panel 62 may be made of a semi-rigid material. In this example, the saddle panel 62 may include a preformed profile shape approximating the profile shape of the body 105 of the instrument 100. The semi-rigid material may also be capable of flexing or bending to small degree to conform to profile shape of the body 105 of the instrument 100.

Each cinch member 84 includes a lip 86 (identified individually herein as a first lip 86A and a second lip 86B in FIG. 5) disposed on a free end, opposite to the seat member 82, of the cinch member 84.

In an example embodiment, the saddle assembly 60 includes the pair of attachment, or cinch, straps 64 (identified individually herein as a first strap 64A and a second strap 64B in FIG. 5) to securely attach the apparatus 10 to the instrument 100. In this embodiment, the strap 64 is a strip of elastic material (e.g., an elastic strap) connected to the cinch member 84.

As best illustrated in FIGS. 4 and 5, the strap 64 forms a loop 65 (identified individually herein as a first loop 65A and a second loop 65B in FIG. 5) that extends, or wraps, around the bottom, or underside, of the body 105 of the instrument 100 and at least partially up an opposing side of the body 105 of the instrument 100. A central portion of the loop 65 of the strap 64 is connected to the lip 86 disposed at the end of the opposing cinch member 84.

In an example implementation, to connect the apparatus 10 to the instrument 100, the saddle panel 62 of the saddle assembly 60 is positioned on the instrument 100. The seat member 82 of the saddle panel 62 is positioned at a desired location on the top surface of the body 105 of the instrument 100. The first (e.g., right) cinch member 84A is positioned at least partially around the first (e.g., right) side of the body 105 of the instrument 100. The second (e.g., left) cinch member 84B is positioned at least partially around the opposing second (e.g. left) side of the body 105 of the instrument 100. The first loop 65A of the first strap 64A, connected to and extending from the first cinch member 84A, is wrapped under the body 105 of the instrument 100 and connected to the second lip 86B of the second cinch member 84B. Likewise, the second loop 65B of the second strap 64B, connected to and extending from the second cinch member 84B, is wrapped under the body 105 of the instrument 100 and connected to the first lip 86A of the first cinch member 84A.

The elasticity of the material of the straps 64 provides for the length of each strap 64 to be easily adjustable to fit different sizes and types of instruments 100. The straps 64 can also be installed and/or removed quickly and without the need for a tool. In an example embodiment, the straps 64 may be fabricated from a material that provides a sufficient width to provide a friction interface between (e.g., in contact with) a surface of the instrument 100 to stabilize the apparatus 10 upon the instrument 100. In another example, a contact (e.g., underside) surface of the straps 64 may include or be coated with a friction material configured to increase friction between the strap 64 and the surface of the instrument 100.

Referring now particularly to FIG. 5, in an example embodiment, the saddle assembly 60 include a layer of padding 76 (also referred to as a padding layer) connected to or otherwise disposed on a bottom, or underside, surface of the saddle panel 62 (e.g., the seat member 82 and at least a portion of each cinch member 84). As an example, the padding 76 may be affixed to the bottom surface of the saddle panel 62 using adhesives or other type of bonding material. In an example embodiment, it is envisioned that various models of the apparatus 10 include padding 76 having a custom shape to match the contours of a particular instrument 100 onto which the apparatus 10 is installed.

Figure 6:
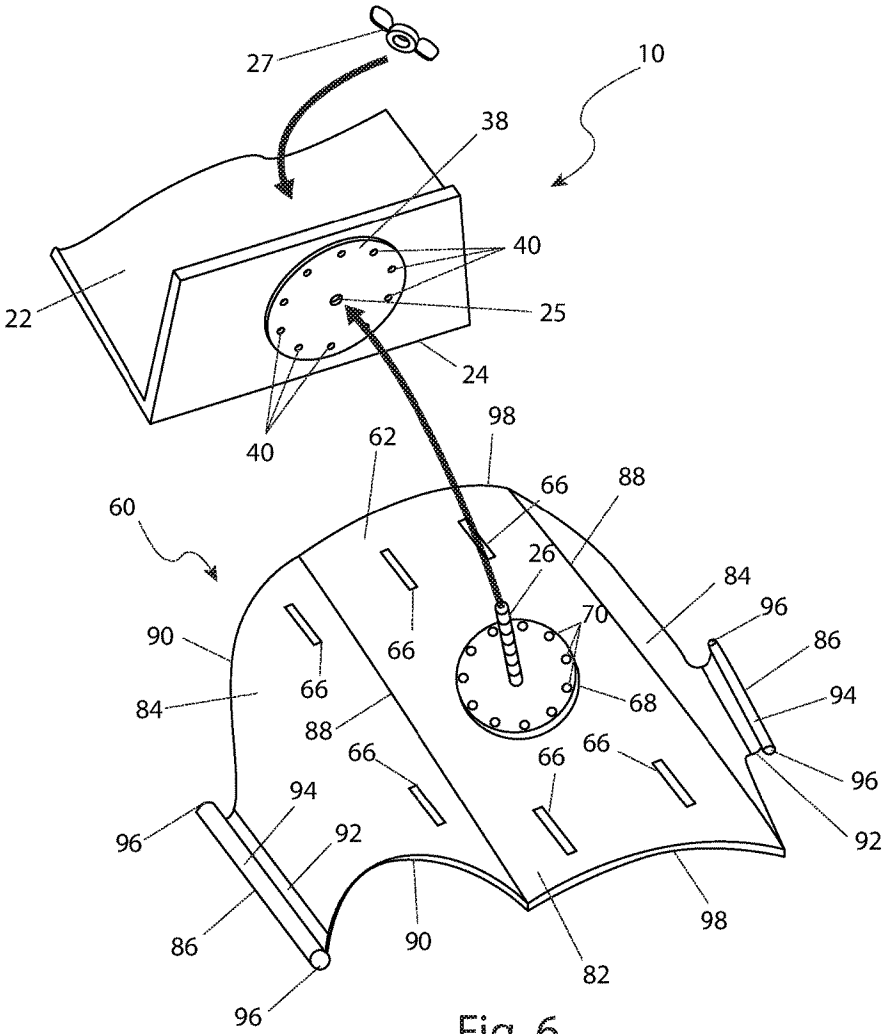

FIG. 6 is a schematic illustration of an exploded view of another embodiment of the holder assembly 20 and the saddle assembly 60 of the disclosed apparatus 10. In an example embodiment, the seat member 82 of the saddle panel 62 of the saddle assembly 60 includes an approximately rectangular shape, in plan view. However, in other embodiments, the seat member 82 may have any suitable shape. Each cinch member 84 extends outwardly and depends downwardly from longitudinal sides 88 of the seat member 82. As expressed above, prior to apparatus 10 being installed on the instrument, when the saddle panel 62 is formed of the flexible material, the saddle panel 62 may be approximately planar, with the cinch members 84 extending outwardly from the sides 88 of the seat member 82. Upon placement on the instrument 100, the cinch members 84 are deflected (e.g., bent) downwardly. Alternatively, and as expressed above, when the saddle panel 62 is formed of the semi-rigid material, the saddle panel 62 has a curved profile shape approximately conforming to the shape of the body 105 of the instrument 100 with the cinch members 84 extending outwardly and downwardly from the sides 88 of the seat member 82.

The saddle mounting plate 68 is affixed (e.g., permanently connected or integral) to the top surface of the seat portion 82 of the saddle panel 62. The saddle assembly 60 includes the threaded stud fastener 26 extending upwardly from the center of the top surface of the saddle mounting plate 68. As an example, the saddle assembly 60 includes the central saddle fastener aperture 28 that extends through the center of the saddle mounting plate 68 and through the seat member 82 of the saddle panel 62. The stud fastener 26 extends through the aligned holder fastener aperture 25 and saddle fastener aperture 28 when the holder mounting plate 38 and the saddle mounting plate 68 are engaged.

Each cinch member 84 tapers inwardly from the seat member 82 to the lip 86. As an example, the cinch member 84 includes an opposed pair of curved sides 90. Each side 90 of the cinch member 84 curves inwardly from the side 88 of the seat member 82 to the lip 86 (e.g., an inwardly curved side 90).

The lip 86 extends outwardly, for example, approximately perpendicularly, from the end of the cinch member 84. The lip 86 includes, or forms, a groove 92 and a ridge 94. As an example, a portion of the lip 86 increases in thickness as it extends outwardly from the surface of the cinch member 84 forming the ridge 94 and the groove 92 positioned between the ridge 94 and the surface of the cinch member 84. When the loop 65 formed by the strap 64 (FIGS. 1 and 2) connects to the lip 86, a portion of the loop 65 is received within the groove 92 and is retained within the groove 92 by the ridge 94. In other words, the ridge 94 serves to hold the strap 64.

In an example embodiment, the lip 86 also includes, or forms, an opposed pair of flanges 96. As an example, a portion of the lip 86 (e.g., the ridge 94) increases in length as it extends outwardly from the surface of the cinch member 84 forming the flanges 96 extending outwardly from opposing ends of the ridge 94 beyond the sides of the groove 92, for example, extending beyond the sides 90 of the cinch member 84 at the lip 86. When the loop 65 formed by the strap 64 (FIGS. 1 and 2) connects to the lip 86, a portion of the loop 65 partially wraps around the pair of flanges 96 to further retain the strap 64 within the groove 92.

Referring to FIGS. 4-6, in an example embodiment, the strap 64 is (e.g., formed from) a strip of elastic material connected at each end to the cinch member 84, for example, extending through an associated strap aperture 66 formed through saddle panel 62. As an example, the ends of the strap 64 may be connected or otherwise retained on the bottom, or underside, surface of the saddle panel 62 and the strap 64 extends through an associated pair of strap apertures 66. In this embodiment, each strip of elastic material of the strap 64 forms an associated loop 65.

In another example embodiment, the strap 64 is (e.g., formed from) a continuous strip (e.g., loop) of elastic material. As an example, the continuous strip of elastic material may extend from the bottom surface of the saddle panel 62 and between and through the associated longitudinally opposed pair of strap apertures 66 formed through the saddle panel 62. In this embodiment, each continuous strip of elastic material of the strap 64 forms an associated loop 65.

In another example, both straps 64 (e.g., the first strap 64A and the second strap 64B) is (e.g., formed from) a continuous strip (e.g., loop) of elastic material. As an example, the continuous strip of elastic material may extend from the bottom surface of the saddle panel 62 between and through the associated laterally opposed pair of strap apertures 66 formed through the saddle panel 62, and between and through the associated longitudinally opposed pair of strap apertures 66 formed through the saddle panel 62. In this embodiment, each continuous strip of elastic material of the strap 64 forms both associated loops 65 (e.g., the first loop 65A and the second loop 65B).

Referring to FIG. 6, in an example embodiment, the strap apertures 66 may include four (4) strap apertures 66 formed through the saddle panel 62. As an example, two (2) sets of strap apertures 66 may each include a pair of longitudinally opposed strap apertures 66. In an example embodiment, the strap apertures 66 may be formed through the seat member 82, for example, proximate to the longitudinal sides 88 and the lateral sides 98 (e.g., at or near corners of the seat member 82). In another example embodiment, each pair of strap apertures 66 may be formed through an associated on the cinch members 84, for example, proximate to the longitudinal sides 88 of the seat member 82. However, in other embodiments, the location of the strap apertures 66 may vary.

Referring to FIGS. 4-6, in an example embodiment, the disclosed apparatus 10 includes the saddle assembly 60 having a shape approximately matching an outer profile shape of a top portion of the instrument 100. The saddle assembly 60 includes the opposing pair of lips 86. Each (e.g., one (1)) lip 86 of the pair of lips 86 is disposed on each side of the saddle assembly 60. The pair of straps 64 is connected to the saddle assembly 60. Each (e.g., one (1)) strap 64 of the pair of straps 64 is disposed on each side of the saddle assembly 60. Each strap 64 of the pair of straps 64 is configured to be wrapped underneath a bottom portion of the instrument 100 and connected to a corresponding lip 86 of the pair of lips 86 disposed on an opposite side of the saddle assembly 60 to secure the saddle assembly 60 to the instrument 100. The apparatus 10 also includes the holder assembly 20 connected to the saddle assembly 60. The holder assembly 20 is configured to retain at least one (1) sheet of copy 30.

In another example embodiment, the disclosed apparatus 10 includes the saddle assembly 60 including the saddle panel 62 having a shape approximately matching an outer profile shape of a top portion of the instrument 100. The saddle panel 62 includes the seat member 82 and the pair of cinch members 84. Each (e.g., one) cinch member 84 of the pair of cinch members 84 extends outwardly from each side of the seat member 82. The saddle mounting plate 68 is connected to a first surface of the seat member 82. The saddle mounting plate 68 includes the saddle fastener aperture 28 located through a center of the saddle mounting plate 68 and the seat member 62. The saddle panel 62 includes the opposing pair of lips 86. Each (e.g., one (1)) lip 86 of the pair of lips 86 is disposed on an end of the cinch member 84. The padding layer 76 connected to and coextensive with a second surface of the saddle panel 62. The second surface is adapted to contact the instrument 100 when the saddle panel 62 is placed thereon. The pair of straps 64 is connected to the saddle assembly 60. Each (e.g., one (1)) strap 64 the pair of straps 64 is disposed on each side of the saddle panel 62. Each strap 64 of the pair of straps 64 is configured to be wrapped underneath the bottom portion of the instrument 100 and connected to a corresponding lip 86 of the pair of lips 86 disposed on an opposite side of the saddle panel 62 to secure the saddle assembly 62 to the instrument 100. The apparatus 10 includes the holder assembly 20 connected to the saddle assembly 60. The holder assembly 20 includes the rear panel 22 configured to retain at least one (1) sheet of copy 30 connected to the rear panel 22 and the lower panel 24 extending approximately perpendicularly from a lower end of the rear panel 22. The holder mounting plate 38 is connected to a first surface of the lower panel 24. The holder mounting plate 38 including a holder fastener aperture 25 located through a center of the holder mounting plate 38 and the lower panel 24. The holder mounting plate 38 engages the saddle mounting plate 68 when the holder assembly 20 is connected to the saddle assembly 60. The fastener 26 extends through the first aperture 28 and second aperture 25 when the holder mounting plate 38 and the saddle mounting plate 68 are engaged and the first aperture 28 and second aperture 25 are aligned to fasten the holder assembly 20 to the saddle assembly 60.

In another example embodiment, the disclosed apparatus 10 includes a saddle assembly 60 including the saddle panel 62 having a shape approximately matching an outer profile shape of the top portion of an instrument 100. The saddle panel 62 includes the seat member 62, the first cinch member 84 extending outwardly from a first side of the seat member 62 and the second cinch member 84 extending outwardly from a second side of the seat member 62. The saddle mounting plate 68 is connected to a top surface of the seat member 62. The saddle mounting plate 68 includes the saddle fastener aperture 28 located through a center of the saddle mounting plate 68 and the seat member 62. The saddle mounting plate 68 includes the plurality of detents 40 arranged in a second circular configuration adjacent an edge thereof. The first lip 86A is disposed on an end of the first cinch member 84. The first lip 86A includes the first ridge 94 extending outwardly from the end of the first cinch member 84 and forming the first groove 92 between the first ridge 94 and the first cinch member 84. The second lip 86B is disposed on an end of the second cinch member 84. The second lip 86B includes the second ridge 94 extending outwardly from the end of the second cinch member 84 and forming the second groove 92 between the second ridge 94 and the second cinch member 84. The padding layer 76 is connected to and coextensive with a bottom surface of the saddle panel 62. The bottom surface is adapted to contact the instrument 100 when the saddle panel 62 is placed on the instrument 100. The first elastic strap 64A forming the first continuous loop 65A is connected to a first side of the saddle panel 62 and configured to be wrapped underneath the bottom portion of the instrument 100. The first strap 64A is connected to the second lip 86 to partially secure the saddle assembly 60 to the instrument 100 by the first continuous loop 65A being received within the second groove 92 and retained by the second ridge 94. The second elastic strap 64B forming the second continuous loop 65B connected to a second side of the saddle panel 62 and configured to be wrapped underneath the bottom portion of the instrument 100. The second strap 64B is connected to the first lip 86 to partially secure the saddle assembly 60 to the instrument 100 by the second continuous loop 65B being received within the first groove 92 and retained by the first ridge 94. The apparatus 10 includes the holder assembly 20 connected to the saddle assembly 60. The holder assembly 20 includes the rear panel 22 configured to retain at least one sheet of copy 30 connected to the rear panel 22 and the lower panel 24 extending approximately perpendicularly from a lower end of the rear panel 22. The holder mounting plate 38 is connected to a bottom surface of the lower panel 24. The holder mounting plate 38 includes the holder fastener aperture 25 located through a center of the holder mounting plate 38 and the lower panel 24. The holder mounting plate 38 includes the plurality of protrusions 70 arranged in a first circular configuration adjacent an edge thereof. The holder mounting plate 38 engages the saddle mounting plate 68 when the holder assembly 20 is connected to the saddle assembly 60. The holder assembly 20 is rotatably connected to the saddle assembly 60. Alignment of the plurality of protrusions 70 and the plurality of detents 40 when the holder mounting plate 38 and the saddle mounting plate 68 are engaged and the first aperture 28 and second aperture 25 are aligned maintains an angular orientation of the holder assembly 20 relative to the saddle assembly 60. The holder assembly 20 is removably connected to the saddle assembly 60 by the fastener 26 extending through the first aperture 28 and second aperture 25 when the holder mounting plate 38 and the saddle mounting plate 68 are engaged and the first aperture 28 and second aperture 25 are aligned to fasten the holder assembly 20 to the saddle assembly 60.

It is envisioned that other styles and configurations of the disclosed apparatus 10 can be easily incorporated into the teachings of the present disclosure, and only certain example embodiments have been shown and described for purposes of clarity and disclosure and not by way of limitation of scope.

The example embodiments of the disclosed apparatus 10 can be utilized by user in a simple and effortless manner with little or no training. After initial purchase or acquisition of the apparatus 10, it would be installed as indicated in FIGS. 1 and 4.

Another example embodiment of the disclosed method of utilizing the apparatus 10 may be achieved by performing the following steps: procuring a model of the apparatus 10 that provides a saddle assembly 60 having a suitable fit onto an intended instrument 100; positioning the saddle panel 62 upon the body 105 of the instrument 100; conforming the first cinch member 84A of the saddle panel 62 at least partially around the body 105 of the instrument 100, wrapping a first strap 64A around the body 105; connecting the first loop 65A formed by the first strap 64A to the first lip 86A of the first cinch member 84A; repeating the above steps for the second strap 64B; installing the holder assembly 20 onto the saddle assembly 60, if not previously installed, by inserting the stud portion 26 of the lower mounting plate 68 up through the fastener aperture portion 25 of the upper mounting plate 38; installing the wing nut 27 upon the stud 26 loosely; lifting and rotating the holder assembly 20 to a desired orientation and corresponding viewing angle; lowering the holder assembly 20 to engage the detents 40 and protuberances 70; securing the position of the holder assembly 20 by tightening the wing nut 27; preparing a plurality of sheets of copy 30 in a back-to-back manner; containing the copy 30 by either laminating or inserting the pairs of copy 30 in clear plastic sleeves; punching holes through the copy 30; mounting a desired number of sheets of copy 30 onto the ring portions 32 of the rear panel 22; and, securing the copy 30 to the rear panel 22 using the wire stay 36, as needed.

The apparatus 10 may be used by a marching band members or similar performers using brass instruments 100 to position a plurality of sheets of copy 30 in a hands-free manner. During performances, an observed page of copy 30 may be changed when desired by either flipping one (1) or more sheets over a top portion of the rear plate 22, or by loosening the wing nut 27 and rotating the holder assembly 20 one-hundred eighty degrees (180°) to access additional sheets of copy 30.

Alternate embodiments of the apparatus 10 are envisioned to provide differently sized and shaped saddle panels 62 and corresponding padding 76 designed to conform to exterior contours of different brass instruments 100 from a trumpet to a sousaphone, so as to position the apparatus 10 properly and securely.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

The invention claimed is:

1. A music lyre comprising:

a saddle assembly having a shape approximately matching an outer profile shape of a top portion of an instrument, said saddle assembly comprising an opposing pair of lips, wherein a lip of said pair of lips is disposed on each side of said saddle assembly comprising:

a saddle panel comprising:

a seat member;

a pair of cinch members extending outwardly from said seat member;

a padding layer connected to and coextensive with a second surface of said saddle panel, and wherein said second surface is adapted to contact said instrument when said saddle panel is placed thereon;

wherein said lip of said pair of lips is disposed on an end of each cinch member of said pair of cinch members; and, wherein said pair of lips each comprises a ridge extending outwardly from said end of said cinch member, wherein a groove is formed between said ridge and said cinch member, and wherein said strap is received within said groove and is retained by said ridge when said strap is wrapped underneath said bottom portion of said instrument and connected to said corresponding lip of said pair of lips;

a saddle mounting plate connected to a first surface of said seat member;

wherein said holder assembly further comprises a holder mounting plate connected to a first surface of said lower panel;

wherein said holder mounting plate engages said saddle mounting plate when said holder assembly is connected to said saddle assembly;

a pair of straps connected to said saddle assembly, wherein a strap of said pair of straps is disposed on said each side of said saddle assembly, and wherein each strap of said pair of straps is configured to be wrapped underneath a bottom portion of said instrument and connected to a corresponding lip of said pair of lips disposed on an opposite side of said saddle assembly to secure said saddle assembly to said instrument; and, a holder assembly connected to said saddle assembly, wherein said holder assembly is configured to retain at least one sheet of copy comprising:

a holder panel comprising:

a rear panel; and, a lower panel extending approximately perpendicularly from a lower end of said rear panel;

wherein said at least one sheet of said copy is connected to said rear panel;

a stay having a first end connected to a first surface of said rear panel above said lower panel and a second end;

wherein said second end of said stay is biased towards said first surface of said rear panel;

wherein said stay is configured to retain a plurality of sheets of copy in a stacked arrangement and, wherein said plurality of sheets of copy is capable of being connected to and retained by said rear panel, thereby enabling individual sheets to be viewed independently;

wherein said holder mounting plate comprises a first aperture located through a center thereof;

wherein said saddle mounting plate comprises a second aperture located in a center thereof;

wherein a fastener extends through said first aperture and second aperture when said holder mounting plate and said saddle mounting plate are engaged and said first aperture and second aperture are aligned to fasten said holder assembly to said saddle assembly;

wherein said holder mounting plate comprises a plurality of protrusions arranged in a first circular configuration adjacent an edge thereof;

wherein said saddle mounting plate comprises a plurality of detents arranged in a second circular configuration adjacent an edge thereof;

wherein said plurality of protrusions is aligned with said plurality of detents when said holder mounting plate and said saddle mounting plate are engaged and said first aperture and second aperture are aligned;

wherein said holder assembly is rotatably connected to said saddle assembly, and wherein alignment of said plurality of protrusions is aligned with said plurality of detents maintains an angular orientation of said holder assembly relative to said saddle assembly; and, wherein said holder assembly is removably connected to said saddle assembly.

2. A music lyre comprising:

a saddle assembly comprising a saddle panel having a shape approximately matching an outer profile shape of a top portion of an instrument, said saddle panel comprising:

a seat member;

a pair of cinch members, wherein one cinch member of said pair of cinch members extends outwardly from each side of said seat member;

a saddle mounting plate connected to a first surface of said seat member, said saddle mounting plate comprises a saddle fastener aperture located through a center of said saddle mounting plate and said seat member;

an opposing pair of lips, wherein one lip of said pair of lips is disposed on an end of said cinch member; and, a padding layer connected to and coextensive with a second surface of said saddle plate, wherein said second surface is adapted to contact said instrument when said saddle panel is placed thereon;

a pair of straps connected to said saddle assembly, wherein one strap said pair of straps is disposed on each side of said saddle panel, and wherein each strap of said pair of straps is configured to be wrapped underneath a bottom portion of said instrument and connected to a corresponding lip of said pair of lips disposed on an opposite side of said saddle panel to secure said saddle assembly to said instrument; and, a holder assembly connected to said saddle assembly, said holder assembly comprising:

a rear panel configured to retain at least one sheet of copy is connected to said rear panel;

a lower panel extending approximately perpendicularly from a lower end of said rear panel; and, a holder mounting plate connected to a first surface of said lower panel, said holder mounting plate comprising a holder fastener aperture located through a center of said holder mounting plate and said lower panel, wherein said holder mounting plate engages said saddle mounting plate when said holder assembly is connected to said saddle assembly; and, a fastener extending through said saddle fastener aperture and said holder fastener aperture when said holder mounting plate and said saddle mounting plate are engaged and said saddle fastener aperture and said holder fastener aperture are aligned to fasten said holder assembly to said saddle assembly.

3. The lyre of claim 2, wherein said holder assembly further comprises:

a pair of apertures disposed through said rear panel, one aperture of said pair of apertures being adjacent to each edge of said rear panel;

a pair of rings, one ring of said pair of rings passing through each aperture, wherein each ring is capable of being secured to a plurality of sheets of copy; and, a stay having a first end connected to a first surface of said rear panel above said lower panel and a second end, wherein said second end of said stay is biased towards said first surface of said rear panel to retain said plurality of sheets of copy in a stacked arrangement;

wherein said plurality of sheets of copy is capable of being connected to and retained by said rear panel, thereby enabling individual sheets to be viewed independently.

4. The lyre of claim 3, wherein:

said holder assembly is rotatably connected to said saddle assembly;

said holder mounting plate comprises a plurality of protrusions arranged in a first circular configuration adjacent an edge thereof;

said saddle mounting plate comprises a plurality of detents arranged in a second circular configuration adjacent an edge thereof, and, alignment of said plurality of protrusions and said plurality of detents when said holder mounting plate and said saddle mounting plate are engaged and said first aperture and second aperture are aligned maintains an angular orientation of said holder assembly relative to said saddle assembly.

5. The lyre of claim 3, wherein:

said saddle panel further comprises a plurality of strap apertures disposed through at least one of said seat member and said pair of cinch members;

said pair of straps each comprises an elastic strap forming a continuous loop; and, said continuous loop extends through at least one of said plurality of strap apertures to connect said strap to said saddle panel.

6. The lyre of claim 5, wherein said pair of lips each comprises a ridge extending outwardly from said end of said cinch member, wherein a groove is formed between said ridge and said cinch member, and wherein said strap is received within said groove and is retained by said ridge when said strap is wrapped underneath said bottom portion of said instrument and connected to said corresponding lip of said pair of lips.

7. The lyre of claim 6, wherein said ridge comprises an opposed pair of flanges that extend outwardly beyond opposed sides of said cinch member.

8. A music lyre comprising:

a saddle assembly comprising a saddle panel having a shape approximately matching an outer profile shape of a top portion of an instrument, said saddle panel comprising:

a seat member;

a first cinch member extending outwardly from a first side of said seat member;

a second cinch member extending outwardly from a second side of said seat member;

a saddle mounting plate connected to a top surface of said seat member, said saddle mounting plate comprising:

a saddle fastener aperture located through a center of said saddle mounting plate and said seat member; and, a plurality of detents arranged in a second circular configuration adjacent an edge thereof;

a first lip disposed on an end of said first cinch member, said first lip comprising a first ridge extending outwardly from said end of said first cinch member and forming a first groove between said first ridge and said first cinch member;

a second lip disposed on an end of said second cinch member, said second lip comprising a second ridge extending outwardly from said end of said second cinch member and forming a second groove between said second ridge and said second cinch member; and, a padding layer connected to and coextensive with a bottom surface of said saddle panel, wherein said second surface is adapted to contact said instrument when said saddle panel is placed on said instrument;

a first elastic strap forming a first continuous loop connected to a first side of said saddle panel and configured to be wrapped underneath a bottom portion of said instrument, wherein said first strap is connected to said second lip to partially secure said saddle assembly to said instrument by said first continuous loop being received within said second groove and retained by said second ridge;

a second elastic strap forming a second continuous loop connected to a second side of said saddle panel and configured to be wrapped underneath said bottom portion of said instrument, wherein said second strap is connected to said first lip to partially secure said saddle assembly to said instrument by said second continuous loop being received within said first groove and retained by said first ridge; and, a holder assembly connected to said saddle assembly, said holder assembly comprising:

a rear panel configured to retain at least one sheet of copy is connected to said rear panel; and, a lower panel extending approximately perpendicularly from a lower end of said rear panel;

a holder mounting plate connected to a bottom surface of said lower panel, said holder mounting plate comprising:

a holder fastener aperture located through a center of said holder mounting plate and said lower panel; and, a plurality of protrusions arranged in a first circular configuration adjacent an edge thereof; and wherein:

said holder mounting plate engages said saddle mounting plate when said holder assembly is connected to said saddle assembly;

said holder assembly is rotatably connected to said saddle assembly;

alignment of said plurality of protrusions and said plurality of detents when said holder mounting plate and said saddle mounting plate are engaged and said saddle fastener aperture and said holder fastener aperture are aligned maintains an angular orientation of said holder assembly relative to said saddle assembly; and, said holder assembly is removably connected to said saddle assembly by a fastener extending through said saddle fastener aperture and said holder fastener aperture when said holder mounting plate and said saddle mounting plate are engaged and said saddle fastener aperture and said holder fastener aperture are aligned to fasten said holder assembly to said saddle assembly.

* * * * *